US005433692A

United States Patent [19]

Gutowski

[11] Patent Number: 5,433,692

[45] Date of Patent: Jul. 18, 1995

[54] GUSSET FORMING MACHINE AND GUSSET FORMING PROCESS

[75] Inventor: Richard W. Gutowski, Pewaukee, Wis.

[73] Assignee: Arms Equipment Corporation, Pewaukee, Wis.

[21] Appl. No.: 152,472

[22] Filed: Nov. 15, 1993

[51] Int. Cl.[6] ..... B65H 45/12

[52] U.S. Cl. ..... 493/451; 493/405; 493/252; 493/251; 493/947

[58] Field of Search ..... 493/947, 451, 456, 497, 493/463, 405, 395, 23, 252, 399, 940, 253, 251, 250

[56] References Cited

U.S. PATENT DOCUMENTS

| | | | |
|---|---|---|---|
| 1,968,165 | 3/1930 | Olm | 493/918 |
| 3,434,400 | 3/1969 | Hochfeld | 493/918 |
| 4,175,478 | 11/1979 | Tripler | 493/918 |
| 4,540,390 | 9/1985 | Thorschmidt | 493/947 |
| 4,586,917 | 6/1986 | Robinson | 493/947 |
| 5,064,409 | 11/1991 | Campbell et al. | 493/399 |
| 5,171,202 | 12/1992 | Su | 493/918 |

*Primary Examiner*—Bruce M. Kisliuk
*Assistant Examiner*—Christopher W. Day
*Attorney, Agent, or Firm*—Nilles & Nilles

[57] ABSTRACT

A gusset forming machine includes a mandrel having a support surface on which a blank for the gusset is manually mounted, and one or more pusher assemblies which are driven into contact with the mandrel to deform the blank, thus forming a gusset. Preferably, each pusher assembly includes a holding blade which prevents movement of the blank relatively to the mandrel during the gusset forming operation, and a plurality of pushing blades which deform the blank into valleys formed between adjacent ridges formed on the support surface of the mandrel, thus forming the gusset. The mandrel is preferably movable into and out of alignment with the pusher assembly or assemblies. Multiple pusher assemblies are preferably provided which extend at angles from one another and produce a multi-sided gusset in a single operation.

26 Claims, 12 Drawing Sheets

CONTROLLER
TO 23
10
12
14
16
18
20
22
24
26
28
30
32
34
36
38
40
42
46
48
50
52
68
70
72
74
76
82
84
88
90
92
94
145
146
147
148
149
150
151
152
153
154
155
156

GUSSET FORMING MACHINE AND GUSSET FORMING PROCESS

BACKGROUND OF THE INVENTION

1. Field of the Invention

The invention relates to gusset forming machines and processes and, more particularly, relates to a machine and process for forming gussets used in the edges of expandable folders and the like.

2. Discussion of the Related Art

Many folders, containers, and the like are expandable from a relatively flat state for storage or shipment to a working state for storing articles such as papers. Such expansion is typically enabled by forming the edges of the folders or other articles from pleated gussets each having an effective width which can be selectively varied by alternately collapsing and straightening out the gusset in an accordion-like fashion. Such gussets are typically expandable from a thickness of ⅛" or less to several inches or more.

Gussets of the type discussed above are typically formed by bending paper or cardboard blanks along longitudinal lines so that the resulting gusset is foldable in opposite directions on opposed sides of each line thus permitting the gusset to collapse onto itself. The blanks for the gussets may be scored in the desired locations to facilitate folding.

Heretofore, gussets have usually been formed either by forming the blank by hand or with manually operated knives. These prior art processes are relatively labor intensive and thus are relatively time consuming and expensive. They are also relatively unreliable because they are dependent upon the skills of the individual laborer who may make mistakes, rendering the completed gusset ineffective or useless.

These problems are especially critical when a gusset is formed which extends along the sides and ends of the folder or other article incorporating the gusset. For proper folding, the corners of the gusset must be formed such that the bottom edges of the valleys on one side of each corner are aligned with and extend into the valleys formed between the adjacent ridges on the other side of each corner. Producing such a gusset manually or even via a manually operated machine typically requires at least three separate forming steps—one for each side—and is thus very time consuming. Any misalignment of the ridges and valleys of the adjacent sides may seriously degrade the effectiveness of the gusset. While this problem may be alleviated somewhat by employing scored gussets, it cannot be eliminated entirely. Even those machines which are capable of folding gussets are incapable of forming the corners. The corners must therefore be formed manually in an operation which results in adjacent plates extending in alternate directions at the corners because the pushing forces for adjacent pleats are imposed from adjacent sides, e.g., top and right side, of the gusset. The resulting corner is not only aesthetically unappealing but also tends to trap dust between alternate folds.

OBJECTS AND SUMMARY OF THE INVENTION

It is therefore an object of the invention to provide a machine which is capable of automatically and reliably forming a gusset for a folder or the like.

Another object of the invention is to provide a machine which can quickly and reliably form a multi-sided gusset in a single operation.

Still another object of the invention is to provide a gusset forming machine requiring a minimal of manual skill for its operation.

In accordance with a first aspect of the invention, these objects are achieved by providing a gusset forming machine including a mandrel having a first ridged support surface, a first pusher assembly which is alignable with the first support surface of the mandrel, and a first drive assembly which drives the first pusher assembly into contact with the first support surface of the mandrel. The mandrel preferably has second and third ridged support surfaces with the second and third support surfaces extending at angles from the-first support surface. The machine also preferably includes second and third pusher assemblies, each of which is alignable with a respective one of the second and third support surfaces of the mandrel, and second and third drive assemblies, each of which drives one of the second and third pusher assemblies into contact with the respective support surface of the mandrel.

Preferably, the mandrel has opposed lateral sides and the first support surface of the mandrel has a center ridge and a pair of side ridges disposed between the center ridge and the lateral sides, the ridges defining a pair of generally V-shaped valleys between the center and side ridges. The first pusher assembly preferably includes a holding blade having an abutment surface formed thereon which compliments the shape of an outer surface of the center ridge and a pair of pushing blades disposed on opposite sides of the center blade. The pushing blades have shapes generally complementing those of the valleys and extend into the valleys when the notch of the holding blade engages the outer surface of the center ridge. A pair of outer blades are disposed on outer lateral edges of the pusher assembly and extend adjacent the outer lateral sides of the mandrel when the notch of the holding blade engages the outer surface of the center ridge.

Still another object of the invention is to provide a gusset forming machine which can be adjusted or modified to form different-sized gussets with a minimal of effort.

In accordance with another aspect of the invention, this object is achieved by providing a frame defining a space therein which receives the mandrel and on which are supported the first, second, and third pusher assemblies. The pusher assemblies are detachable from the frame, and the longitudinal length of the frame is adjustable.

Yet another object of the invention is to provide a process for quickly and reliably forming a gusset for use in a folder or the like with a minimum of manual labor.

In accordance with still another aspect of the invention, this object is achieved by 1) supporting a blank on a support surface of a gusset forming machine, the support surface having first and second sides extending at an angle from one another to define an included corner, and 2) automatically deforming the blank onto the support surface to form a gusset having first and second pleated sides extending at an angle from one another and an included pleated corner.

The supporting step preferably comprises supporting the blank on a ridged mandrel presenting the first and second sides. The deforming step preferably comprises driving first and second pusher assemblies towards the first and second sides of the mandrel.

Other objects, features, and advantages of the present invention will become apparent to those skilled in the art from the following detailed description. It should be understood, however, that the following detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

Further objects of the invention will become more readily apparent as the invention is more clearly understood from the detailed description to follow, reference being made to the accompanying drawings in which like reference numerals represent like parts throughout, and in which:

FIG. 1 enlarged view of a portion of FIG. 10 illustrating the mandrel in a retracted position;

DETAILED DESCRIPTION OF THE PREFERRED EMBODIMENTS

RESUME

Figure 1:
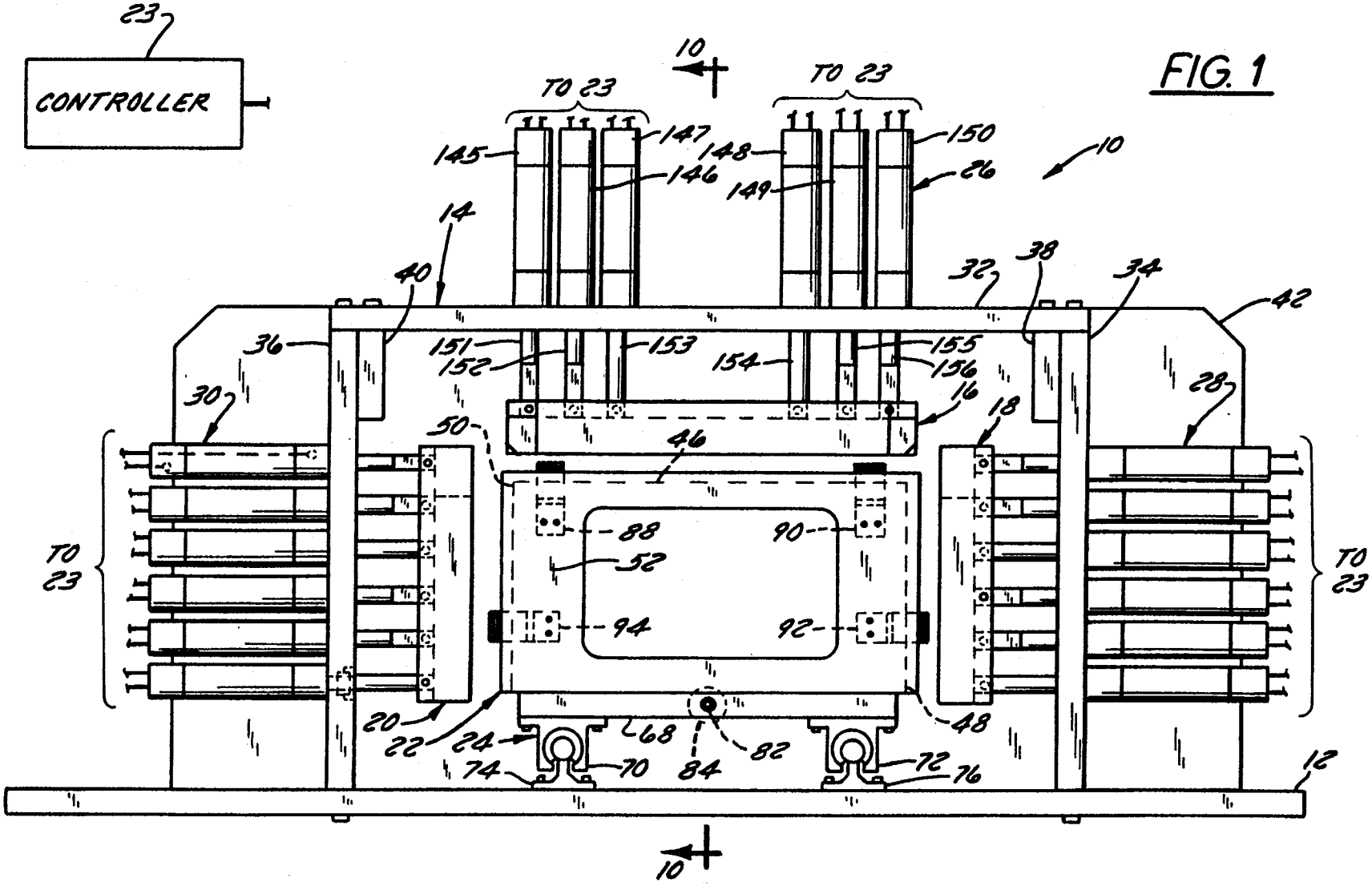
FIG. 1 is a plan view of a gusset forming machine constructed in accordance with a preferred embodiment of the present invention.
Figure 2:
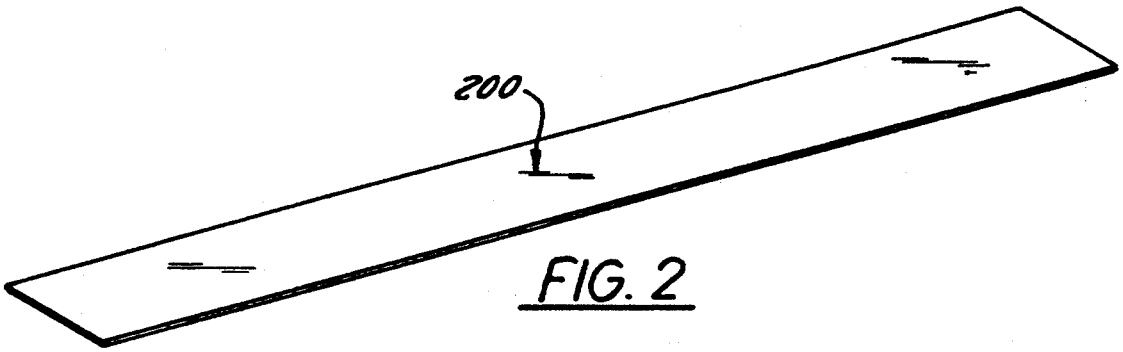
FIG. 2 is a perspective view of a blank which can be formed into a gussets by the gusset forming machine of FIG. 1.
Figure 3:
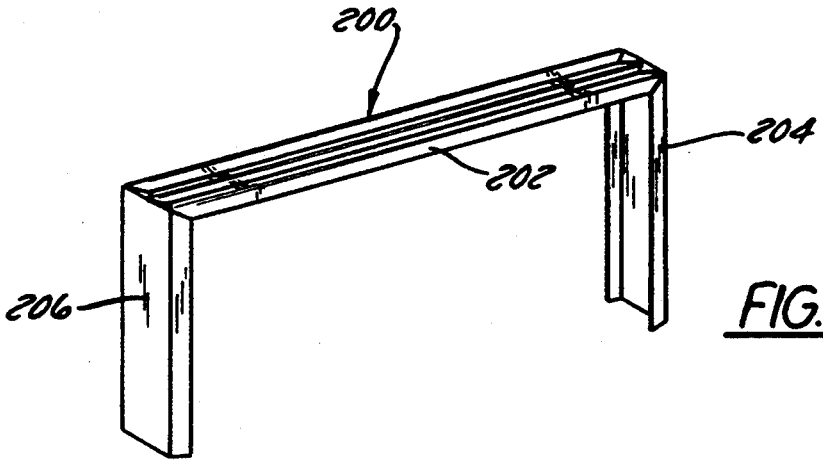
FIG. 3 is a perspective view of a gusset pleated on one side only.
Figure 4:
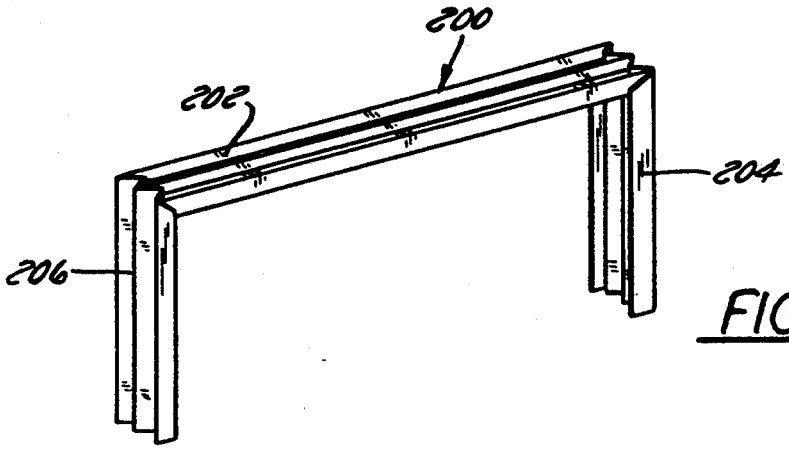
FIG. 4 is a perspective view of a gusset pleated on all sides.

Pursuant to the invention, a gusset forming machine is provided which includes a mandrel having a support surface on which a blank for the gusset is manually mounted, and one or more pusher assemblies which are driven into contact with the mandrel to deform the blank, thus forming a gusset. Preferably, each pusher assembly includes a holding blade which prevents movement of the blank relative to the mandrel during the gusset forming operation, and a plurality of pushing blades which deform the blank into valleys formed between adjacent ridges formed on the support surface of the mandrel, thus forming the gusset. The mandrel is preferably movable into and out of alignment with the pusher assembly or assemblies. Multiple pusher assemblies are preferably provided which extend at angles from one another and produce a multi-sided gusset in a single operation.

Description of Gusset Forming Machine

Referring to the drawings, a gusset forming machine 10 constructed in accordance with the present invention includes a base 12; a frame 14 on which is mounted first, second, and third pusher assemblies 16, 18 and 20; and a mandrel 22 slidably supported on base 12 by a slider 24. First, second, and third drive assemblies 26, 28 and 30 are mounted on respective walls 32, 34 and 36 of frame 14 and are controlled by a controller 23 to selectively actuate respective pusher assemblies 16, 18 and 20.

In the illustrated embodiment, the base 12 and the walls 32, 34 and 36 of frame 14 are each formed from a rigid metal plate. Side walls 34 and 36 are bolted to the base 12 and, if desired, may be braced by support bars (not shown). Upper wall 32 of frame 14 is bolted to the tops of side walls 34 and 36 and also to support bars 38, 40 secured to the upper ends of side walls 34 and 36. An over-sized rear wall 42 is secured to side walls 34 and 36 as well as upper wall 32. Frame 14 need not be constructed as illustrated, but instead could be formed from any structure providing a rigid support for drive assemblies 26, 28 and 30 and pusher assemblies 16, 18 and 20. It is preferred, however, that the frame 14 be capable of being disassembled so that the gusset forming machine 10 can be adapted to form different sized gussets in the manner discussed below.

In the illustrated configuration, gusset forming machine 10 is adapted to form gussets for folders suitable for receiving letter-.sized paper. The gussets formed by the illustrated configuration are also relatively narrow, i.e., on the order of 1" to 2". Accordingly, an upper support surface 46 of mandrel 22 is approximately $11\frac{3}{4}$" long and $1\frac{3}{4}$" wide. The side support surfaces 48 and 50 are of the same width but are somewhat shorter. The support surfaces are preferably formed integral with a metal frame 52 of mandrel 22 such that these surfaces define the outer periphery of the frame 52.

The cross section of each support surface 46, 48 and 50 of mandrel 22 is identical. Accordingly, only the cross section of upper support surface 46 will be described. Referring to FIGS. 10–14, upper support surface 46 includes a center ridge 54 flanked by two edge ridges 56 and 58. In the illustrated embodiment, the ridges 54, 56 and 58 extend at 45° angles from a base of upper support surface 46 so as to define generally V-shaped valleys 62 and 64 therebetween. Preferably, the valleys are notched so as to receive mating lugs on the pusher blades (detailed below) so as to assure adequate folding of the blank. It should be noted, however, that the ridges need not be shaped as illustrated, so long as the support surfaces of the mandrel 22 define valleys in which a blank may be deformed to form a gusset. For example, the ridges 54, 56 and 58 could be of any shape suitable for forming gussets thereon.

The bottom surface of the frame 52 of mandrel 22 is bolted or otherwise secured to a support plate 68 which is in turn mounted on the slider 24. Slider 24 may comprise any suitable device capable of moving mandrel 22 into and out of frame 14, so long as it provides adequate support for the mandrel 22 upon operation of the pusher assemblies 16, 18, 20. In the illustrated embodiment, slider 24 is composed of opposed legs each of which comprises a slide 70 and 72 which is secured to support plate 68 for mandrel 22 and which is slidably supported on rails 74 and 76. The mandrel 22 is driven to slide on slider 24 by a piston and cylinder arrangement 82 acting as a mandrel drive device. This device preferably comprises a double-acting pneumatic cylinder of the type discussed below in connection with drive assemblies 26, 28 and 30. The cylinder (not shown) is mounted on the rear surface of rear wall 42 of frame 14. Movement of the mandrel 22 into the frame 14 is limited by an elastomeric stop 84 which engages an indent 86 (FIGS. 10 and 11) formed in rear wall 42 of frame 14.

Figure 11:
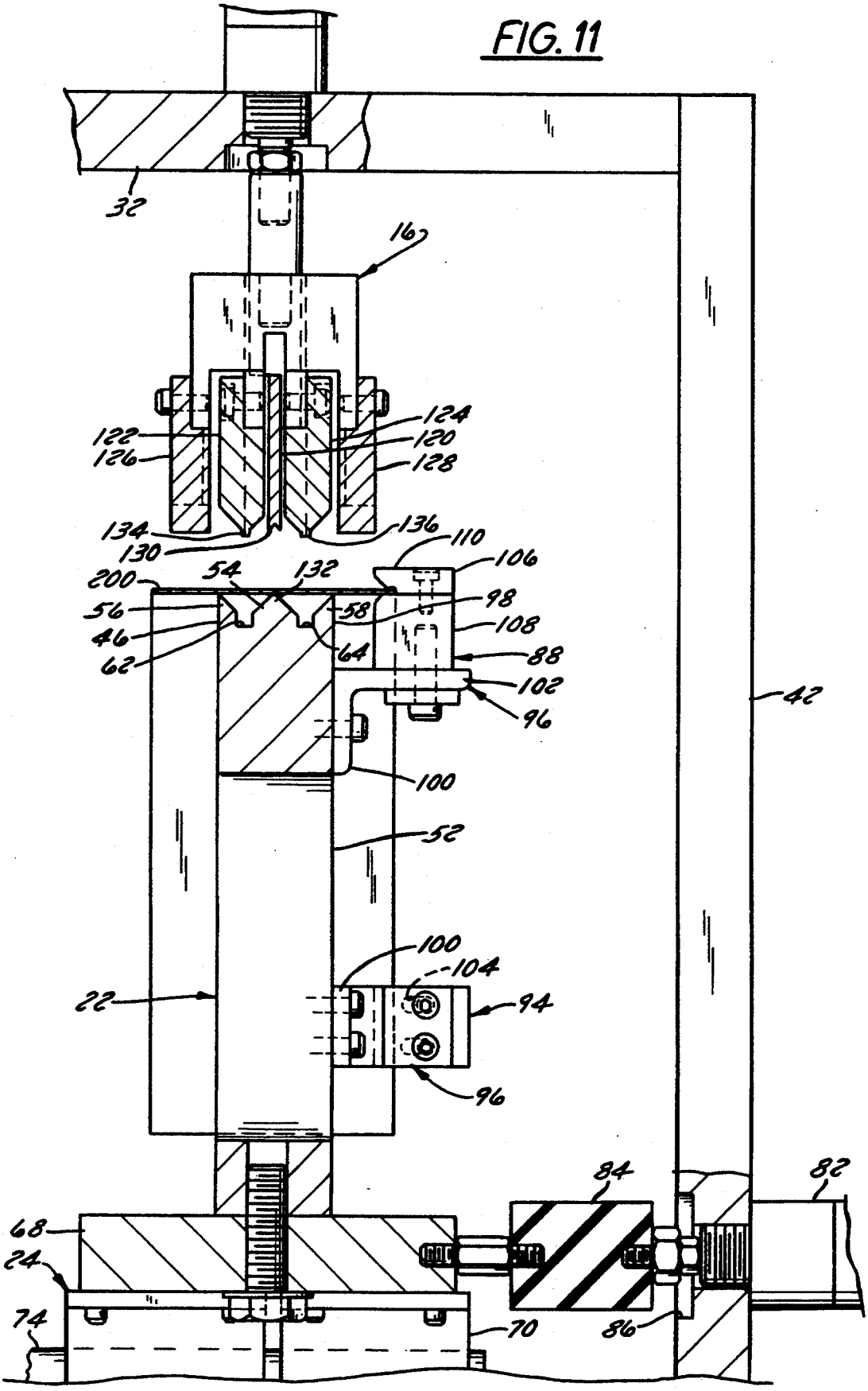
Figure 12:
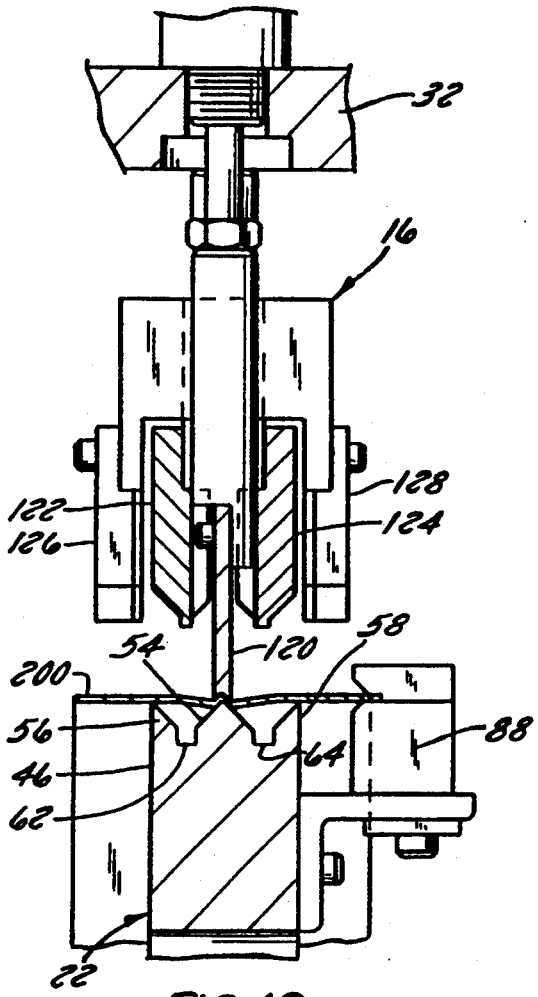
FIGS. 12–14 are sectional elevation views of upper surface of the mandrel and of the associated pusher assembly of the gusset forming machine and illustrate the operational sequence of the pusher assembly.

Clamp assemblies 88, 90, 92 and 94 are provided on the mandrel 22 for holding a blank in position prior to a gusset forming operation. Each of these clamp assemblies is identical in construction and operation. Accordingly, only clamp assemblies 88 and 94 on the right side of the frame 52 of mandrel 22 will be described. Referring especially to FIG. 11, each of the clamp assemblies 88, 94 includes an L-shaped bracket 96 which is secured to the rear surface 98 of the frame 52 of mandrel 22. A first leg 100 of bracket 96 is bolted or otherwise affixed to rear surface 98 of frame 52, and a second leg 102 extends orthogonally from the first leg and has slots 104 formed therein which are aligned with mating holes (not shown) in a base 108 of a clamp 106 of the clamp assembly.

The clamp 106 of each of the clamp assemblies 88, 94 is slidable along slots 104 in the second leg 102 of bracket 96 so as to vary the spacing between the rear surface 98 of the frame 52 and the clamp 106, thus varying the distance at which a blank may overhang the rear surface 98 of frame 52. The clamp 106 further includes a retainer 110 which is secured to the base 108 with a space formed therebetween for receiving the blank. The retainer 110 is biased towards the base 108 by an internal spring (not shown) so as to clamp the blank between the retainer 110 and the base 108 when the edge of the blank is inserted into the space formed therebetween.

Of course, the clamp assemblies 88, 90, 92 and 94 need not be constructed as illustrated. However, it is preferred that these clamp assemblies provide sufficient clamping forces to hold a blank in place while the gusset forming machine is being readied for operation but which permit the blank to be pulled out of the clamps by the pusher assemblies during operation of the machine without damage to the blank. It is also preferred that the distance between the clamps of the respective clamp assemblies and the rear surface 98 of the frame 52 of the mandrel 22 be variable for the reason discussed above.

As discussed above, each of the pusher assemblies 16, 18 and 20 is mounted on a respective wall 32, 34, 36 of the frame 14 by a respective drive assembly 26, 28, 30. The first pusher assembly 16 engages the upper surface 46 of mandrel 22 but is somewhat shorter than surface 46. Second and third pusher assemblies 18 and 20 engage the right and left side surfaces 48 and 50 of mandrel 22 and have upper surfaces extending generally coplanar with the tops of these surfaces. The upper ends of the pushing blades of the pusher assemblies 18 and 20 thus engage the opposed longitudinal ends of the valleys 62 and 64 formed in support surface 46 of mandrel 22. This construction forms a gusset in which the bottom edge of each valley of each side of the gusset extends into the valleys 62 and 64 formed between the adjacent ridges of the top of the gusset. This permits proper folding of the gussets at its corners and also forms unidirectional pleats at the corners providing advantages detailed below.

Although the pusher assemblies vary in length, each is otherwise identical in construction. Thus, referring to FIGS. 11–15, the following description of first pusher assembly 16 is equally applicable to second and third pusher assemblies 18 and 20. A side pusher assembly 18 is illustrated in exploded form in FIG. 16.

First pusher assembly 16 includes a holding blade 120 which is flanked by pushing blades 122 and 124 which are in turn flanked by outer blades 126 and 128. Holding blade 120 functions to hold a blank in position while the pushing blades 122 and 124 and the outer blades 126 and 128 form a gusset from the blank. Accordingly, the holding blade 120 is aligned with the center ridge 54 of the upper support surface 46 of mandrel 22 so as to clamp the blank between the mandrel and the pusher assembly. This clamping effect is achieved in the illustrated embodiment by a tip 132 defining an outer surface of ridge 54 and a complementary notch 130 (FIG. 11) forming an abutment surface of holding blade 120 when the first pusher assembly 16 is actuated by the corresponding drive assembly 26.

Pushing blades 122 and 124 have points 134 and 136 each having a shape which complements the shape of a corresponding one of the valleys 62 and 64 formed in the upper support surface 46 of mandrel 22. These points are inserted into the valleys 62 and 64 when the first pusher assembly 16 is actuated, thus deforming the blank to form the gusset. While this particular shape results in permanent bending of the blank along straight lines and also provides what is considered to be the ideal shape of the gusset formed by the machine, any suitable shape could be used, so long as the shapes of the points of the pushing blades 122 and 124 generally complement the shapes of the corresponding valleys 62 and 64 in upper support surface 46 of mandrel 22.

The free ends of outer blades 126 and 128 do not engage any corresponding elements of the upper support surface 46 of mandrel 22 and thus need not be of any particular shape. Instead, the free ends are designed to extend beyond the outer edges of ridges 56 and 58 of the upper support surface 46 of mandrel 22 such that the inner surface of the respective outer blade is disposed adjacent a respective outer lateral surface of mandrel 22. These outer blades form lips on the edges of the blank for connection to the edges of the sides of the folder after the gusset forming operation.

As discussed above, the pusher assemblies 16, 18, and 20 are actuated by drive assemblies 26, 28, and 30. Each of the drive assemblies 26, 28 and 30 is identical in construction. Accordingly, only the drive assembly 26 for the first pusher assembly 16 will be discussed in detail.

Drive assembly 26 may include any device capable of moving the individual blades of the first pusher assembly 16 towards and away from the mandrel 22 in the desired sequence. In the illustrated embodiment, drive assembly 26 includes six double-acting pneumatic piston and cylinder devices 145–150 extending through and mounted on the top wall 32 of frame 14. Devices 145–150 include pistons 15–156 (FIG. 1) which extend into the internal chamber defined by the frame 14 and have supports 157–162 (FIG. 15) affixed to the free ends thereof or formed integral therewith. Stops (not shown) may be provided on the ends of pistons 151–156 proximate the supports 157–162 to limit outward travel of the second pusher assembly 18 by engaging recesses (not shown) formed in side wall 34 of frame 14. The individual pneumatic cylinders 145–150 are connected by pneumatic hoses (not shown) to the central controller 23, which also supplies pressurized air to the corresponding cylinders for first and third drive assemblies 26 and 30 and the cylinder for the mandrel drive device in a manner detailed below.

Figure 15:
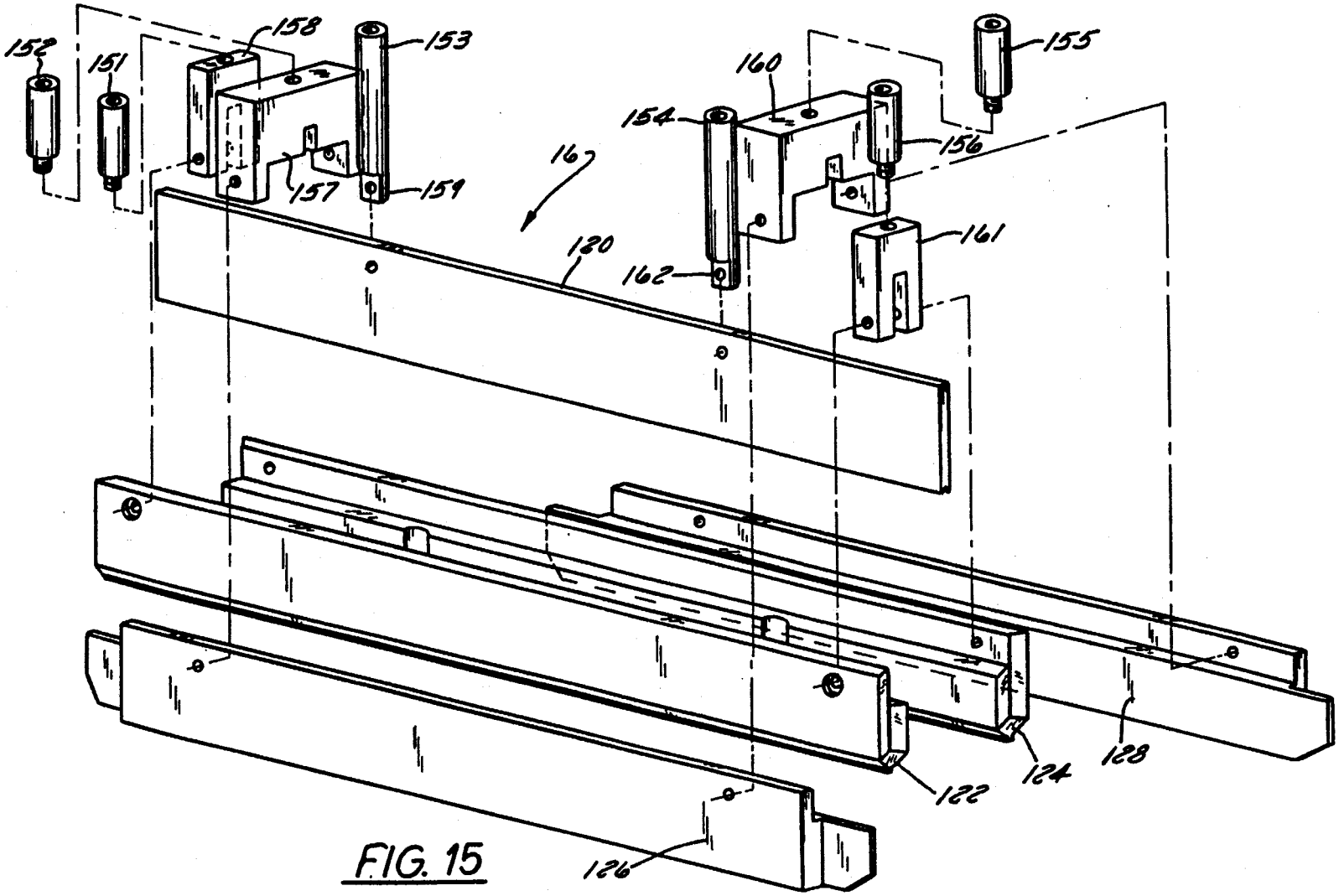
FIGS. 15 and 16 are exploded perspective views of the upper and right side pusher assemblies of the gusset forming machine.
Figure 16:
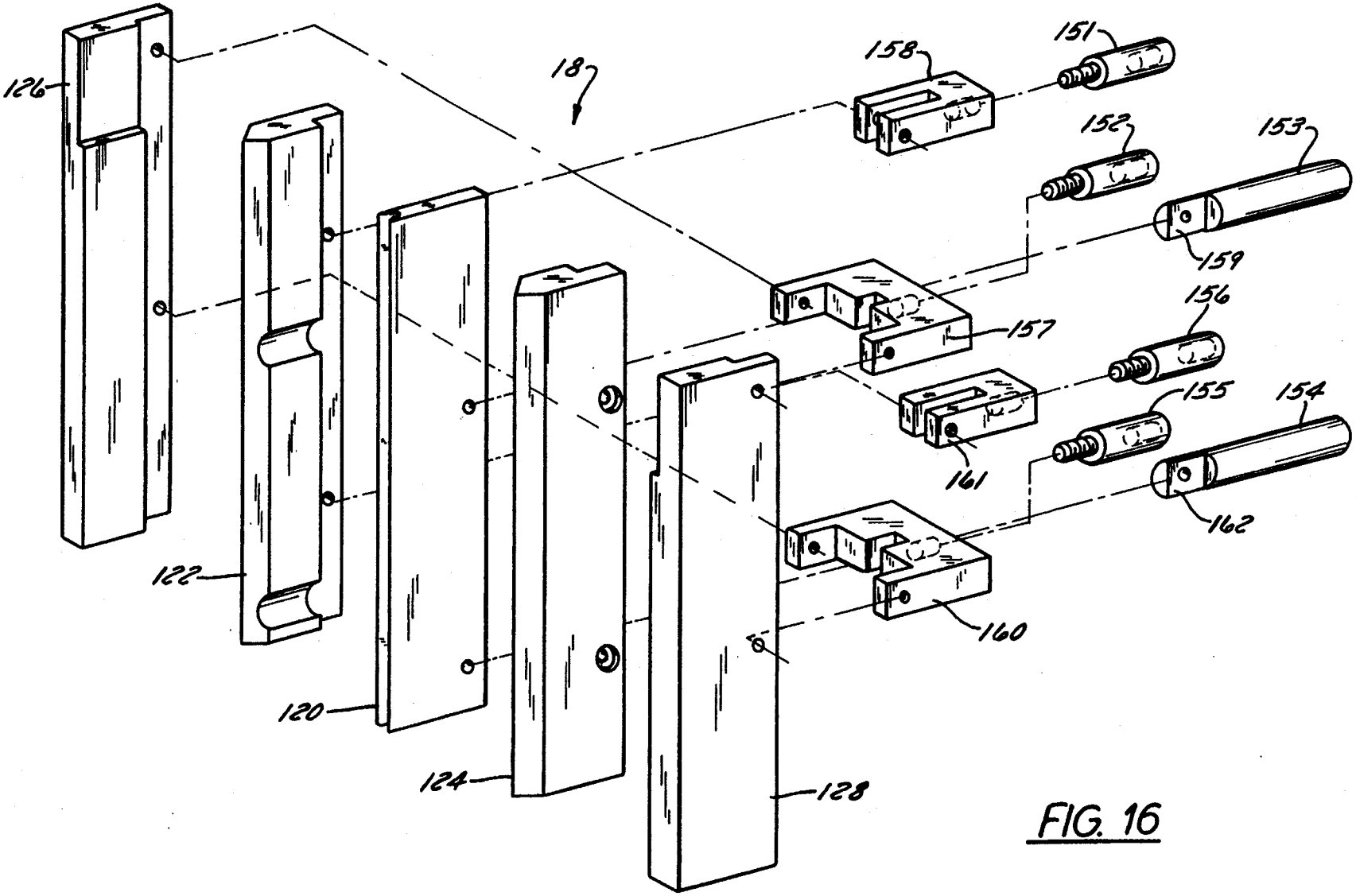

Each of the supports 157–162 is specially designed so as to engage one or more of the blades of the associated pusher assembly without obstructing the remaining blades while retaining the necessary spacing between each adjacent blade. Thus, as illustrated in FIGS. 15 and 16, supports 157 and 160 are generally T-shaped and have a central notch formed therein for engaging the holding blade 120, edge flanges for engaging the outer blades 126 and 128, and detents on which rest the pushing blades 122 and 124. Supports 158 and 161 are narrower and do not contact the outer blades 126 and 128 but instead have a pair of opposed flanges receiving the holding blade 120 therebetween and having the pushing blades 122 and 124 secured to the outside thereof. Finally, supports 159 and 162 each comprise a notched cylinder formed on the end of the associated piston 53, 154 and receiving the holding blade 120 in the notch.

Controller 23 includes a source of compressed air and suitable valving and electronics for selectively connecting the source of compressed air to the supply hoses for the pneumatic cylinders 145–150 of each of the drive assemblies 26, 28, and 30, as well as the pneumatic cylinder for the mandrel drive device. The controller 23 includes suitable timers for operating the slider 24 prior to operation of the drive assemblies 26, 28, and 30, as well as timers for simultaneously driving the drive assemblies towards the mandrel, for holding the drive assemblies in place, and for subsequent withdrawing the drive assemblies from the mandrel. The pneumatic and electronic control circuitry for providing the desired functions are, per se, well known to those skilled in the art and, accordingly, will not be described in greater detail.

Operation of Gusset Forming Machine

Referring to FIGS. 1–14, a gusset is formed by the gusset forming machine 10 in the following process.

Figure 5:
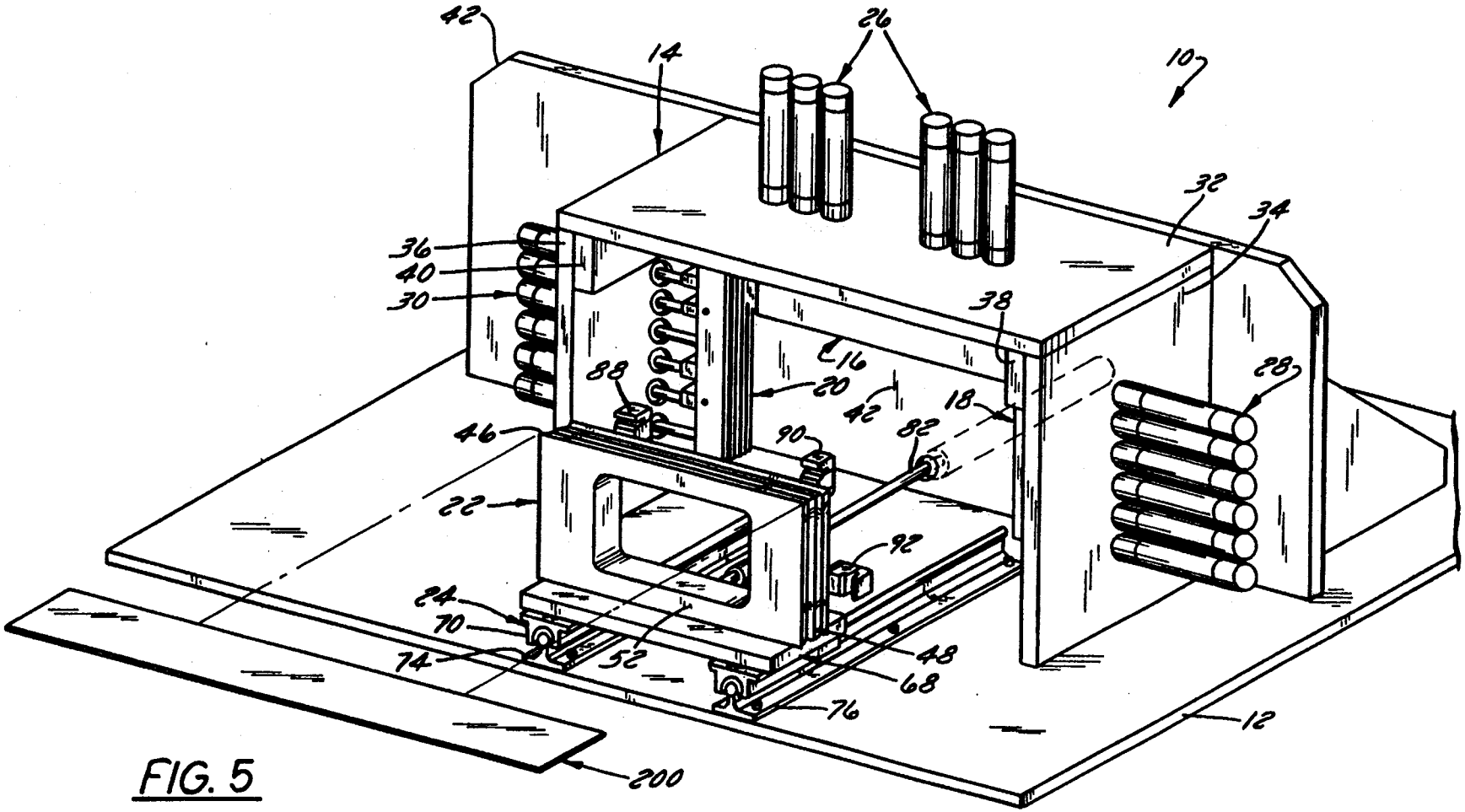
FIG. 5 is a perspective view of the gusset forming machine of FIG. 1 with a blank readied for placement on the mandrel of the machine.
Figure 6:
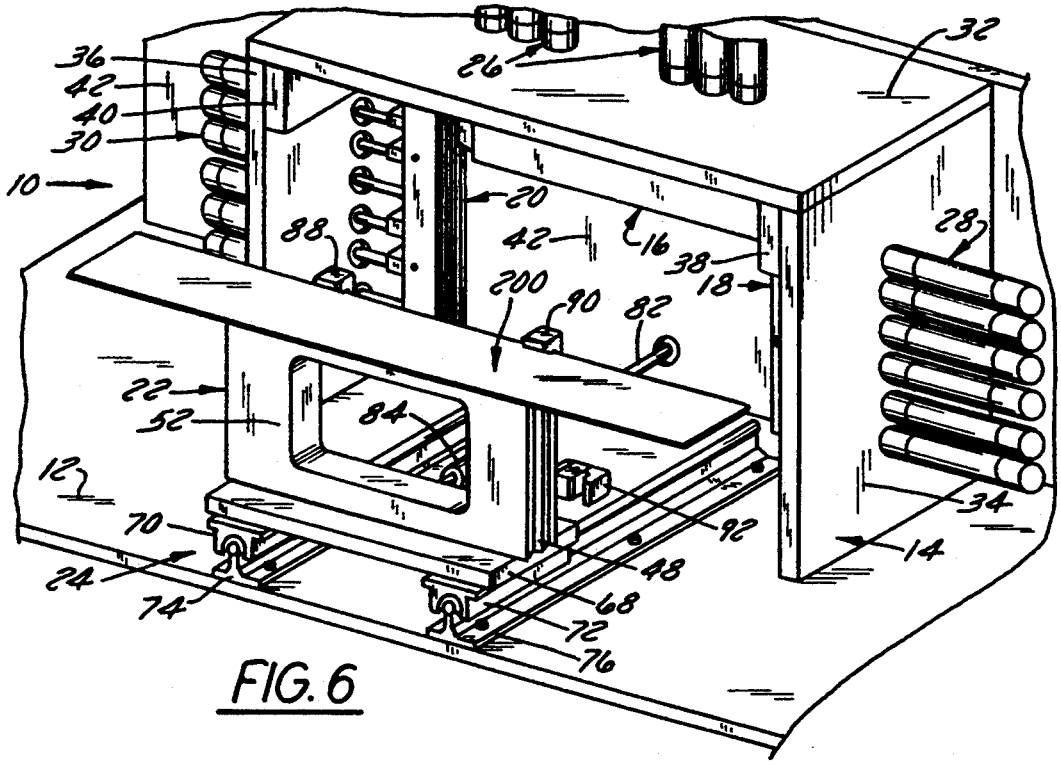
FIG. 6 is a perspective view of the gusset forming machine of FIGS. 1 and 5 with a blank partially placed on the mandrel of the machine.
Figure 7:
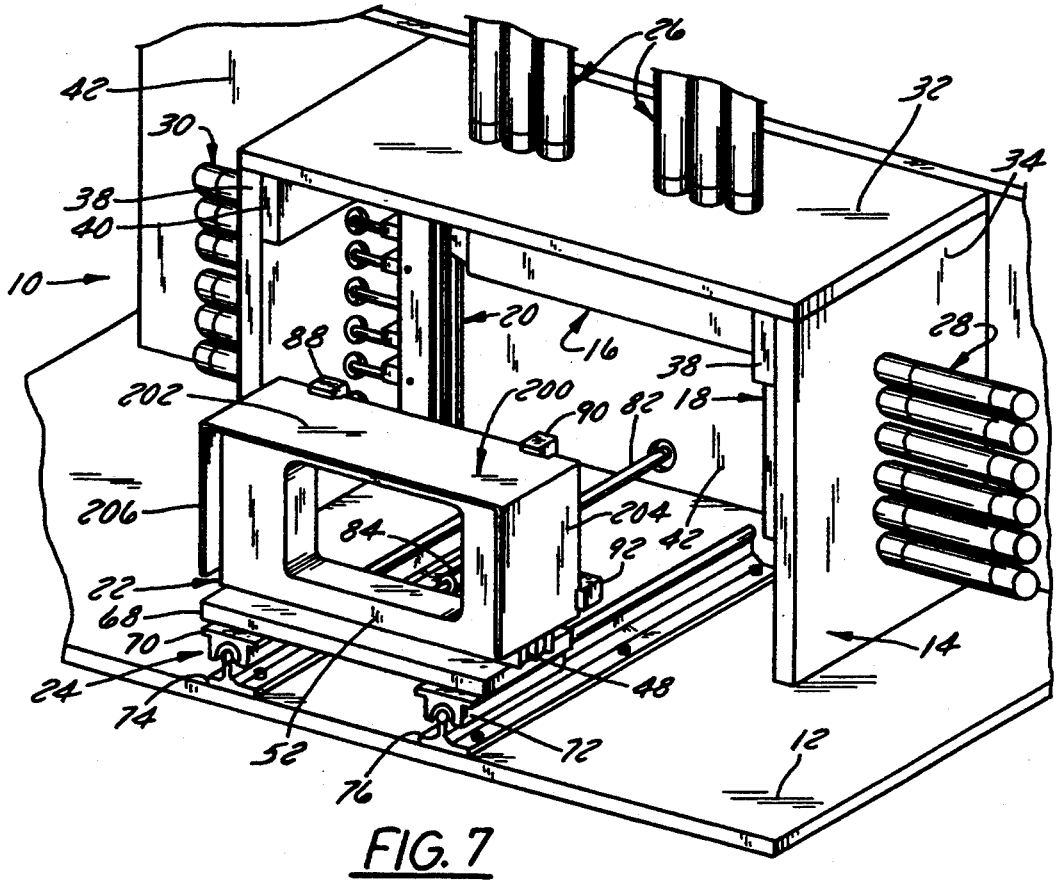
FIG. 7 is a perspective view of the gusset forming machine of FIGS. 1, 5, and 6 with the blank completely placed on the mandrel of the machine.
Figure 8:
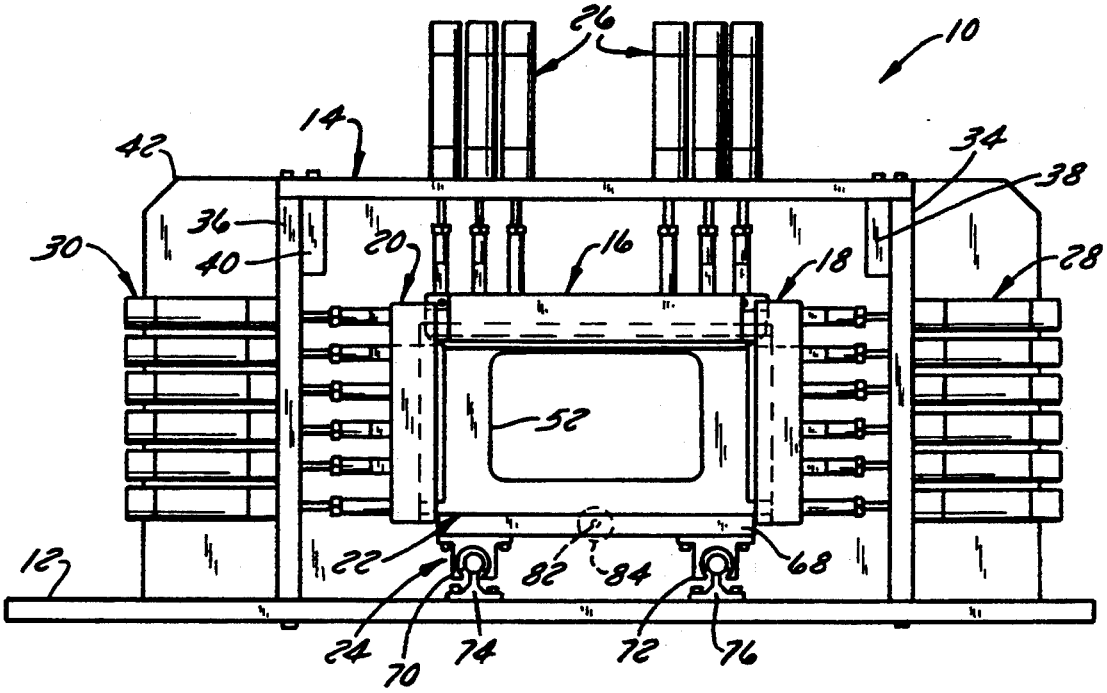
FIG. 8 is a plan view of the gusset forming machine with its pusher assemblies being activated to form a gusset from the blank.
Figure 9:
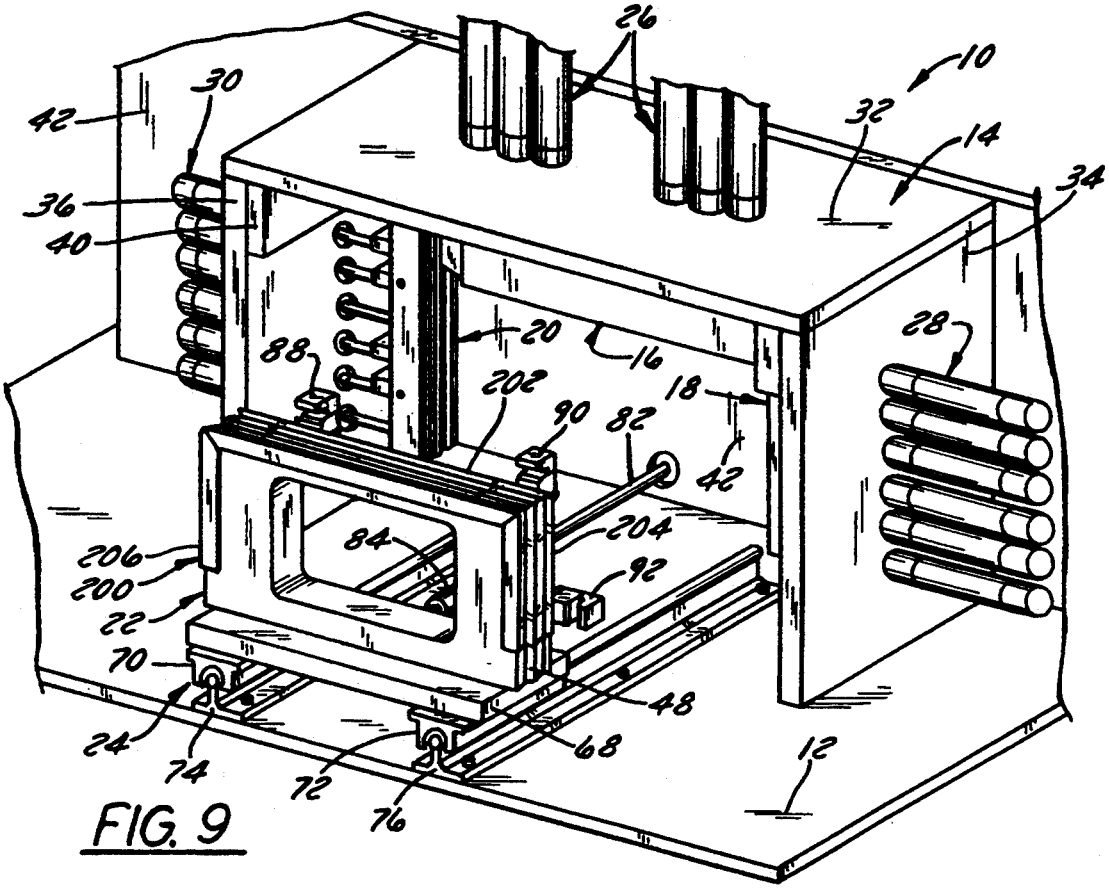
FIG. 9 is a perspective view of the gusset forming machine with a formed gusset on the mandrel.
Figure 10:
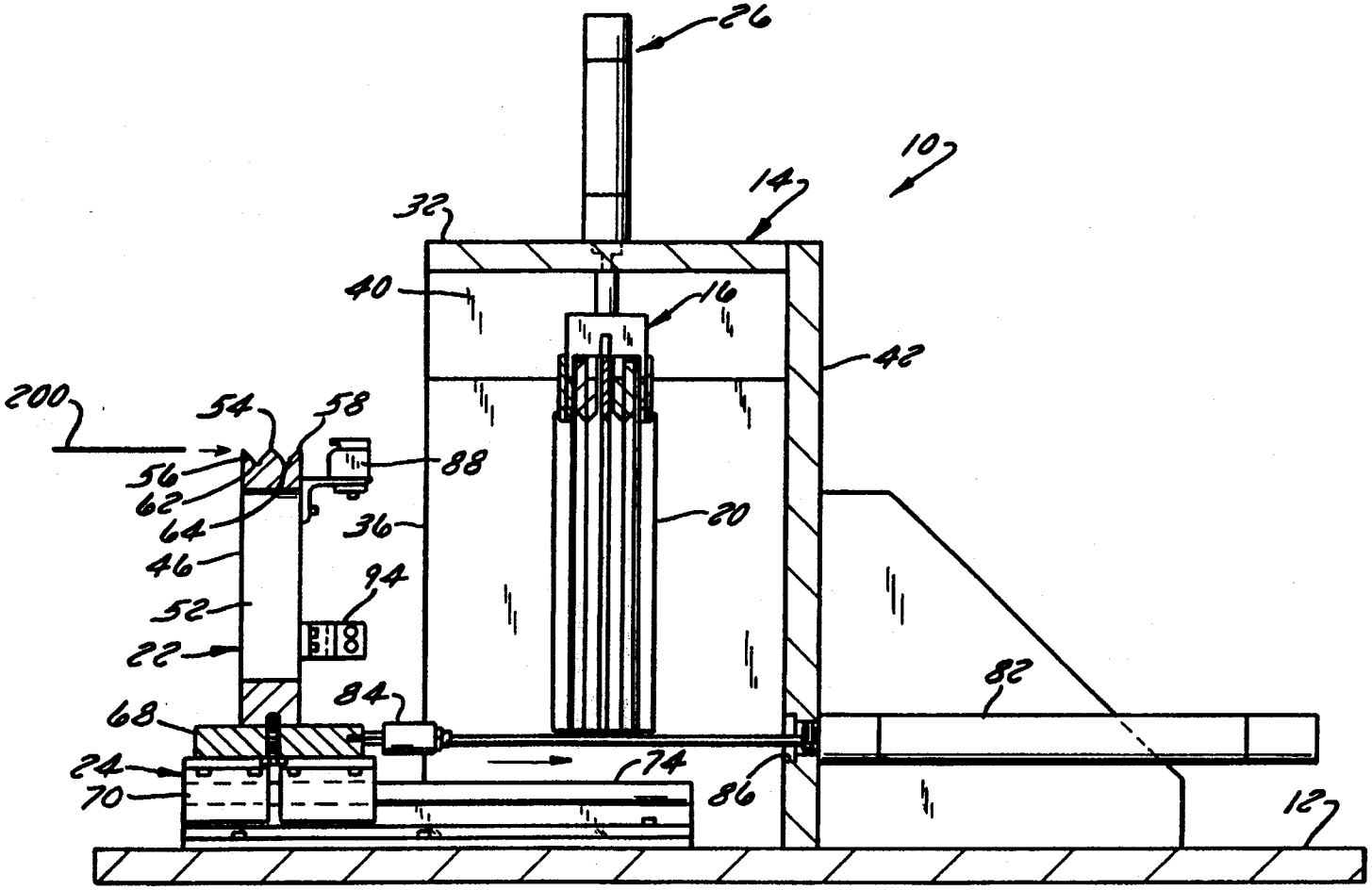
FIG. 10 is a sectional end view taken along the lines 10—10 of FIG. 1, illustrating the mandrel in an extended position.

First, referring to FIGS. 5–7, a blank 200 is placed on the support surfaces 46, 48 and 50 of mandrel 22 and bent at its ends to form three sections 202, 204 and 206 which abut the respective first through third support surfaces 46, 48 and 50 of mandrel 22. The blank 200 may include a plurality of longitudinally extending scores formed therein to facilitate folding. Such scores, if present, should be aligned with the peaks and valleys of the support surfaces 46, 48 and 50 of the mandrel 22 and of the points of the pushing blades of the pusher assemblies 16, 18, 20. Such alignment can be assured by previously setting the position of clamping assemblies 88, 90, 92 and 94. However, these scores are not necessary if notched blades of the illustrated type are employed and thus are not employed in the illustrated embodiment.

After the blank 200 has been secured to the mandrel 22, a gusset forming operation is initiated by actuating controller 23 through operation of a suitable switch. The controller 23 first actuates the piston 82 of the associated pneumatic double-acting piston and cylinder arrangement to drive the mandrel 22 into the frame 14 on the slide 24 from the position illustrated in FIGS. 7 and 10 to that illustrated in FIGS. 9 and 11 in which stop 84 engages indent 86 formed in the rear wall 42 of frame 14. The mandrel 22 will now be aligned with the pusher assemblies 16, 18 and 20.

Figure 13:
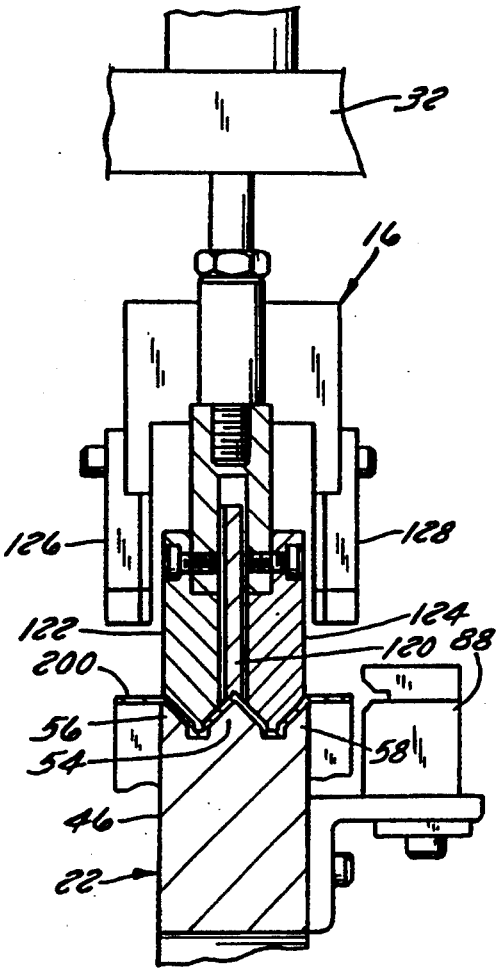
Figure 14:
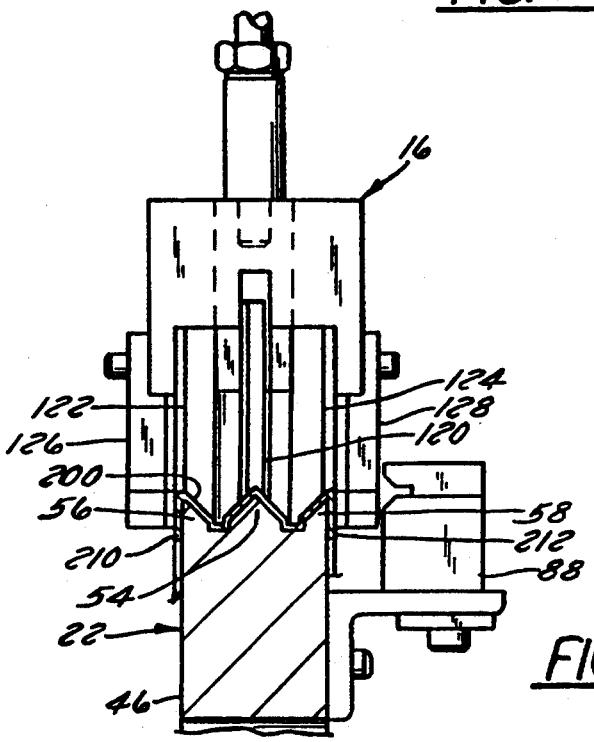

The controller 23 then actuates each of the drive assemblies 26, 28 and 30 to drive the pusher assemblies 16, 18 and 20 in the following sequence. First, the holding blade 120 of each assembly 16, 18, or 20 is driven downwardly to clamp the blank 200 between the tip of blade 120 and the center ridge 54 of the associated support surface. Then, the pushing blades 122 and 124 are driven into the valleys 62 and 64 as illustrated in FIG. 13 to deform the blank 200 into pleats. Permanent bending along straight lines is assured because the lugs on the tips of blades 122 and 124 force the blank into the notches in the valleys 62, 64. This operation also pulls the edges of the blank 200 out of the clamps 88, 90, 92, and 94. Finally, the outer blades 126 and 128 are driven downwardly as illustrated in FIG. 14 to form lips 210, 212 on the gusset for connection to the edges of the sides of the folder or other article incorporating the gusset.

The controller 23 continues to pressurize the pneumatic cylinders of drive assemblies 26, 28 and 30 for a designated period of time of, e.g., five seconds, so as to assure that the deformation of the blank 200 is permanent. Then, the controller 23 reverses the pressure in the pneumatic cylinders of the drive assemblies 26, 28 and 30 to withdraw the pusher assemblies 16, 18 and 20 from the mandrel 22. This reversal may be achieved, e.g., by switching valves which alternately pressurize first and second sides of a piston provided in each of the piston and cylinder assemblies. Finally, the pressure on the piston 82 of the associated piston and cylinder arrangement driving the slider 24 is reversed to drive the mandrel 22 back out of the frame 14. The gusset formed by blank 200, having the shape illustrated in ]FIG. 4, can now be lifted off from the mandrel 22 and inserted into the edge of a folder or the like.

The sequence described above forms an entire three sided gusset, including the corners, in a single operation. The corners are formed from unidirectional pleats which are aesthetically more attractive than those formed by hand and which are less prone to trapping dust than those formed by hand.

Adjustment of Gusset Forming Machine to Produce A Different Size Blank

Figure 17:
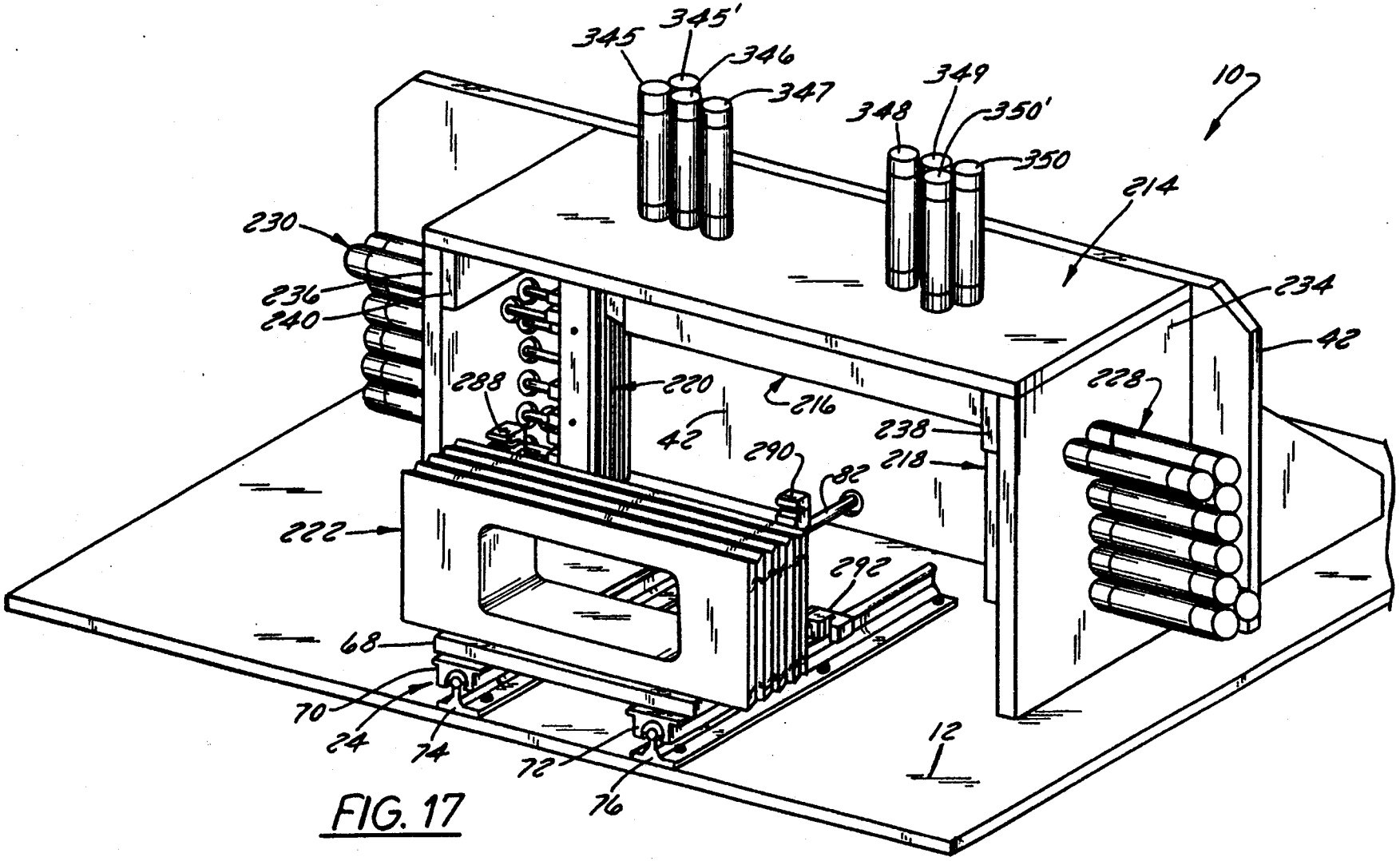
FIG. 17 is a perspective view of the gusset forming machine of FIG. 1 after the machine has been adjusted or modified to form a different-sized gusset.
Figure 18:
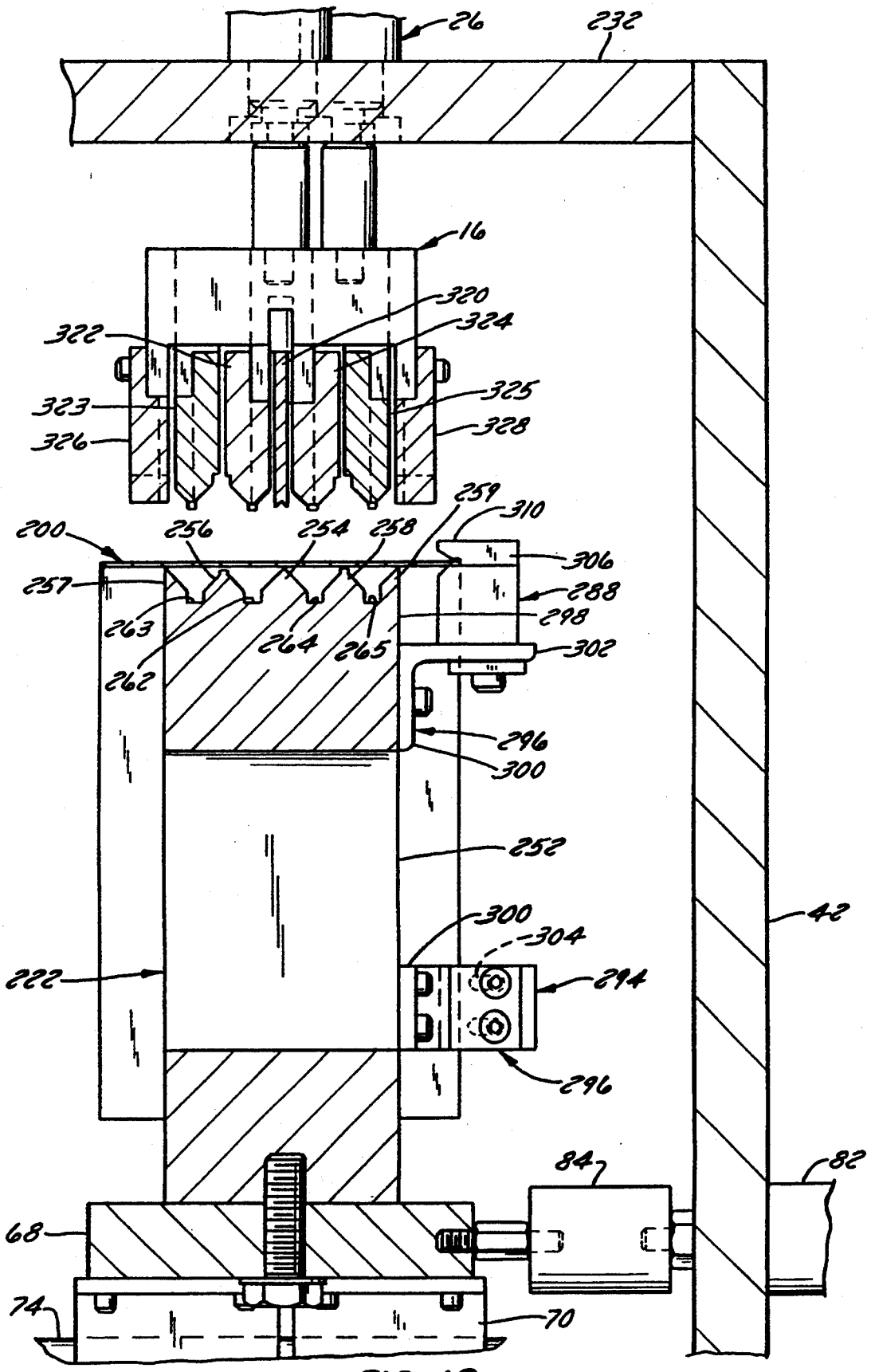
FIG. 18 is a sectional elevation view of the upper surface of the mandrel and of the associated pusher assembly of the gusset forming machine of FIG. 17.

As discussed above, a gusset forming machine constructed in accordance with the present invention can preferably be adjusted to produce different-sized gussets. Thus, in the illustrated embodiment, the gusset forming machine 10 of FIGS. 1 and 5–16 can be adjusted as illustrated in FIGS. 17 and 18. The adjusted machine has the same base 12 and slider 24, but has a different frame 214, mandrel 222, and pusher assemblies 216, 218 and 220. All components of the machine 10 which are replaced by corresponding but different-sized components upon modification of the machine are designated by the same reference numeral, incremented by 200.

Frame 214 has side walls 234 and 236 which are the same length as side walls 34 and 36 but which each has an additional hole formed therein which receives an additional double-acting pneumatic cylinder. In addition, upper wall 232 is somewhat longer than the wall 32 illustrated in FIG. 1 so as to be capable of receiving a pusher assembly which, in the illustrated embodiment, forms a gusset for a folder capable of storing legal size or 14½" paper. Wall 232 also has additional holes formed therein which receive additional double-acting pneumatic cylinders 345' and 350' detailed below.

To facilitate assembly, only one side wall 236 of the frame 214 moves upon replacement of the top wall 32 with a longer wall 232. This wall 236 is braced with a support bar 240 positioned laterally outside of the support bar 40 on base 12.

Mandrel 222 is secured to the slider 24 by the same plate 68 which connected the mandrel 22 to the slider 24. Mandrel 222 is thus positioned off-center on slider 24. However, because the mandrel 222 is not subject to significant twisting forces during operation, operation of the slider 24 is not affected.

The gusset forming machine 10 illustrated in FIGS. 17 and 18 has also been modified to produce wider gussets. Accordingly, mandrel 222 is wider than mandrel 22 illustrated in FIG. 1 and has, in addition to a center ridge 254 and flanking ridges 256 and 258 on each of its support surfaces 246, 248 and 250, further flanking ridges 257 and 259. Accordingly, two additional valleys 263 and 265 are formed on opposite sides of the valleys 262 and 264 in each support surface of the mandrel 222. Similarly, additional pusher blades 323 and 325 have been provided between the existing pusher blades 322 and 324 and the outer blades 326 and 328 of each of the pusher assemblies. These additional blades are supported and driven by a seventh pneumatic cylinder 345' and 350' provided in each of the drive assemblies 226, 228 and 230. The construction and operation of the gusset forming machine 10 after being adjusted as illustrated in FIGS. 17 and 18 are otherwise essentially identical to those of the machine prior to adjustment. Accordingly, further description will be omitted to avoid repetition.

Many changes and modifications could be made to the present invention without departing from the spirit and scope thereof. For example, the machine need not be adapted to produce three-sided gussets as illustrated, but could include fewer pusher assemblies and mandrel support surfaces so as to produce two-sided or even one-sided gussets. Different clamping arrangements and/or drive assemblies could be used to actuate the pusher assembly or assemblies. Other possible variations will become apparent from a reading of the appended claims.

What is claimed is:

1. A machine for forming a gusset comprising:

(A) a mandrel having a first ridged support surface;

(B) a first pusher assembly which is alignable with said first support surface of said mandrel, said first pusher assembly including a plurality of independently movable pushing blades; and (C) a first drive assembly which drives said blades of said first pusher assembly into contact with a blank supported on said first support surface of said mandrel.

2. A gusset forming machine according to claim 1, wherein said mandrel has second and third ridged support surfaces, said second and third support surfaces extending at angles from said first support surface, said machine further comprising second and third pusher assemblies, each of which is formed from a plurality of independently movable blades and which is alignable with a respective one of said second and third support surfaces of said mandrel; and (C) second and third drive assemblies, each of which drives the blades of one of said second and third pusher assemblies into contact with a respective one of the support surfaces of said mandrel.

3. A gusset forming machine according to claim 2, further comprising a control system which controls said drive assemblies to drive said first, second, and third pusher assemblies into contact with portions of said blank supported on respective support surfaces of said mandrel, to maintain said contact for a designated period of time, and to simultaneously withdraw said first, second and third pusher assemblies away from said mandrel after said designated period of time, said control system causing the drive assemblies to drive at least some blades of each pusher assembly sequentially.

4. A gusset forming machine according to claim 3, wherein each of said drive assemblies comprises a plurality of double acting pneumatic cylinders, each of which is coupled to at least one of said blades.

5. A gusset forming machine according to claim 2, further comprising a frame defining a space therein which receives said mandrel and on which are supported said first, second, and third pusher assemblies.

6. A gusset forming machine according to claim 5, wherein said pusher assemblies are detachable from said frame and wherein a longitudinal length of said frame is adjustable.

7. A gusset forming machine according to claim 1, wherein said mandrel has opposed lateral sides and said first support surface of said mandrel has a center ridge and a pair of side ridges disposed between said center ridge and said lateral sides, said ridges defining a pair of generally V-shaped valleys between said center and side ridges, and wherein said first pusher assembly includes a holding blade having a notch formed therein which compliments the shape of an outer surface of said center ridge, a pair of pushing blades disposed on opposite sides of said holding blade, said pushing blades having shapes generally complementing those of said valleys and extending into said valleys when said notch of said holding blade engages a portion of said blank supported on said outer surface of said center ridge, said pushing blades being movable independently of said holding blade, and a pair of outer blades disposed on outer lateral edges of said pusher assembly, said outer blades extending adjacent said opposed lateral sides of said mandrel when said notch of said holding blade engages said portion of the blank, said outer blade being movable independently of said holding blades and said pushing blades.

8. A gusset forming machine according to claim 1, further comprising clamps, provided on said mandrel, for holding said blank on said mandrel.

9. A gusset forming machine according to claim 8, wherein each of said clamps is adjustable relative to said mandrel to accommodate blanks of varying widths.

10. A gusset forming machine according to claim 1, wherein said mandrel has a center ridge and a pair of side ridges disposed between said center ridge and said lateral sides, said ridges defining a pair of generally V-shaped valleys between said center and side ridges, and wherein said pusher assembly includes a holding blade which is aligned with said center ridge, and a pair of pushing blades disposed on opposite sides of said holding blade and being movable independently of said holding blades, said pushing blades having shapes generally complementing those of said valleys and being extendable into said valleys when said holding blade engages a portion of said blank supported on said center ridge.

11. A gusset forming machine according to claim 10, wherein said pusher assembly further comprises a pair of outer blades disposed on outer lateral edges of said pusher assembly and movable independently of said holding blade and said pushing blades, said outer blades being extendable adjacent said outer lateral sides of said mandrel when said holding blade engages said portion of said blank.

12. A gusset forming machine according to claim 1, further comprising (A) a frame which defines a space therein and which receives said mandrel and said first pusher assembly, and (B) a mandrel drive device which selectively drives said mandrel to move into and out of said space in said frame.

13. A gusset forming machine (A) a mandrel having a first ridged support surface and second and third ridged support surfaces extending at angles from said first support surface;

(B) first, second, and third pusher assemblies, each of which is alignable with a respective one of the support surfaces of said mandrel;

(C) first, second, and third drive assemblies, each of which drives a respective one of the pusher assemblies into contact with a portion of a blank supported on the respective one of the support surfaces of said mandrel;

(D) a frame defining a space therein which receives said mandrel and on which are supported said first, second, and third pusher assemblies;

(E) a slider on which said mandrel is mounted; and (F) a mandrel drive device which selectively drives said mandrel to move on said slider into and out of said space in said frame.

14. A process of forming a gusset, said process comprising the steps of:

(A) supporting a blank on a ridged mandrel of a gusset forming machine such that a central portion of said blank contacts a first support surface of said mandrel and opposed ends of said blank rest on second and third support surfaces of said mandrel extending at angles from said first support surface; and then (B) actuating first, second, and third pusher assemblies, each of which is alignable with a respective one of the support surfaces of said mandrel, to contact said blank and to deform said blank to generally match the shape of said support surfaces of said mandrel, thereby forming said gusset, wherein said step (B) comprises pushing said pusher assemblies into contact with said blank, maintaining said contact for a designated period of time, and then withdrawing said pusher assemblies away from said mandrel after said designated period of time, and wherein said step of pushing comprises driving a holding blade toward a center ridge of said mandrel, then driving pushing blades into valleys which flank said center ridge of said mandrel, and then driving outer blades beside opposed lateral sides of said mandrel.

15. A process as defined in claim 14, wherein said step of pushing further comprises driving additional pushing blades into additional valleys which flank said valleys, and wherein the step of driving additional pushing blades takes place after the step of driving said pushing blades into valleys of said mandrel.

16. A process of forming a gusset, said process comprising the steps of:

(A) supporting a blank on a ridged mandrel of a gusset forming machine such that a central portion of said blank contacts a first support surface of said mandrel and opposed ends of said blank rest on second and third support surfaces of said mandrel extending at angles from said first support surface; and then (B) actuating first, second, and third pusher assemblies, each of which is alignable with a respective one of the support surfaces of said mandrel, to contact said blank and to deform said blank to generally match the shape of said support surfaces of said mandrel, thereby forming said gusset;

(C) moving said mandrel out of alignment with said pusher assemblies prior to said step (A); and (D) moving said mandrel into alignment with said pusher assemblies after said step (A) and before said step (B).

17. A process according to claim 16, wherein said step of actuating said pusher assemblies and said steps of moving said mandrel into and out of alignment with said pusher assemblies each comprises actuating at least one double acting pneumatic cylinder.

18. A gusset forming machine comprising:

(A) a mandrel having a first ridged support surface and second and third ridged support surfaces extending at right angles from said first support surface, said support surfaces capable of supporting a blank, each of said first, second, and third support surfaces presenting a center ridge and a pair of side ridges disposed between said center ridge and lateral sides of a respective one of the support surfaces, said ridges defining a pair of valleys between said center and side ridges;

(B) first, second, and third pusher assemblies which are alignable with said first, second, and third support surfaces of said mandrel, respectively, each of said pusher assemblies including a holding blade having a notch formed therein which compliments the shape of an outer surface of said center ridge of an associated surface of said mandrel, a pair of pushing blades disposed on opposite sides of said holding blade, said pushing blades having shapes generally complementing those of said valleys of the associated surface of said mandrel and extending into said valleys when said notch of said holding blade engages a portion of said blank supported on said outer surface of said center ridge, and a pair of outer blades disposed on outer lateral edges of said pusher assembly, said outer blades extending adjacent outer lateral sides of said mandrel when said notch of said holding blade engages said portion of said blank; and (C) first, second, and third drive assemblies which drive said first, second, and third pusher assemblies into contact with said first, second, and third support surfaces of said mandrel, respectively.

19. A process of forming a gusset, said process comprising the steps of:

(A) supporting a blank on a ridged mandrel of a gusset forming machine such that a central portion of said blank contacts a first support surface of said mandrel and opposed ends of said blank rest on second and third support surfaces of said mandrel extending at angles from said first support surface; and then (B) actuating first, second, and third pusher assemblies, each of which is alignable with a respective one of the support surfaces of said mandrel, to contact said blank and to deform said blank to generally match the shape of said support surfaces of said mandrel, thereby forming said gusset, wherein each of said pusher assemblies comprises a plurality of independently movable blades, and wherein said actuating step includes sequentially actuating blades of each of said pusher assemblies.

20. A process according to claim 12, wherein said step (B) comprises pushing said pusher assemblies into contact with said blank by sequentially driving at least some of the blades of each of said pusher assemblies, maintaining said contact for a designated period of time, and then withdrawing said pusher assemblies away from said mandrel after said designated period of time.

21. A process according to claim 19, wherein said mandrel and said first pusher assembly are each of a first length capable of forming gussets of a first length, and further comprising the step of replacing said mandrel and said first pusher assembly with a mandrel and a pusher assembly of a second length capable of forming gussets of a second length.

22. A process according to claim 19, comprising the step of replacing said mandrel and said pusher assemblies with a mandrel and pusher assemblies of different widths.

23. A process according to claim 19, wherein said step (A) comprises clamping an edge of said blank in clamps supported on said mandrel, and further comprising adjusting said clamps relative to said mandrel prior to said step (A) to accommodate the width of said blank.

24. A process as defined in claim 19, wherein said step of sequentially actuating comprises first actuating a central holding blade of each of said pusher assemblies and then actuating a pair of pushing blades which flank said holding blade.

25. A process as defined in claim 19, wherein said step of sequentially actuating comprises first actuating a central holding blade of each of said pusher assemblies, then actuating a pair of pushing blades which flank said holding blade, and then actuating a pair of outer blades which flank said pushing blades.

26. A process of forming a multi-sided gusset, said process comprising the steps of:

(A) supporting a blank on a support surface of a gusset forming machine; and (B) automatically deforming said blank onto said support surface to form a pleated side of a gusset, wherein said supporting step comprises supporting said blank on a ridged mandrel presenting said support surface; and said deforming step comprises driving a pusher assembly towards said blank, said pusher assembly comprising a plurality of independently movable blades, said driving step comprising first driving at least one of said blades and then driving at least another of said blades.

* * * * *